US005615274A

United States Patent [19]

Lin

[11] Patent Number: 5,615,274

[45] Date of Patent: Mar. 25, 1997

[54] MULTI-FUNCTION MICROPHONE CONNECTER

[76] Inventor: Jia S. Lin, 9F3R, No. 210, Chung Hsueh Rd., Tainan, Taiwan

[21] Appl. No.: 587,842

[22] Filed: Jan. 11, 1996

[51] Int. Cl.[6] ..... H04R 25/00

[52] U.S. Cl. ..... 381/169; 381/168

[58] Field of Search ..... 381/168, 169, 381/189; 439/638, 639, 462

[56] References Cited

U.S. PATENT DOCUMENTS 4,399,371 8/1983 Ziff et al. ..... 307/147
4,761,823 8/1988 Fier ..... 455/89

*Primary Examiner*—Sinh Tran
*Attorney, Agent, or Firm*—Pro-Techtor International

[57] ABSTRACT

A multi-function microphone connecter includes a main body having a cylindrical member and a dust cover unit combined with a front end of the cylindrical member. The cylindrical member has a large center plug hole for a microphone plug to insert, and small plug holes for another microphone plug to insert. The dust cover unit consists of a rotatble member, a silicon rubber member and an outer cover member. After the dust cover unit are combined with the main body, the rotatable member may be rotated to close up the small plug holes, preventing dust from drifting therein, always keeping normal function. Further, the silicon rubber member has fan-shaped sections able to be pushed to bend inward by the first microphone plug. The fan-shaped sections can close up the large plug hole to prevent dust from moving therein when the second microphone plug is used.

2 Claims, 5 Drawing Sheets

MULTI-FUNCTION MICROPHONE CONNECTER

BACKGROUND OF THE INVENTION

This invention concerns a multi-function microphone connecter, particularly possible to connect two kinds of microphone plugs and to prevent dust from drifting in the connecter.

A known microphone connecter disclosed in an Austrian patent No. AT 399427B , has a design for two kinds of microphone plugs to connect with. The connecter can only used for one kind of plug one time, leaving unused plug holes for dust to drift freely in the connecter body, able to cause incomplete connection between the plug and the plug hole(s), resulting in bad sounds.

SUMMARY OF THE INVENTION

A purpose of the present invention is to offer a multi-function microphone connecter preventing dust from drifting into plug holes.

A feature of the present invention is a cylindrical member of a main body and a dust cover unit, which includes at least a rotatable member, a silicon rubber member, and an outer cover. The outer cover and the silicon rubber member are stationary and the rotatable member can be rotated for a limited angle so that the silicon rubber member may close up a large plug hole and the rotatable member can close up small plug holes, achieving dust prevention.

Another feature of the present invention is grounding plates mounted in an annular groove of the cylindrical member.

BRIEF DESCRIPTION OF DRAWINGS

This invention will be better understood by reference to the accompanying drawings, wherein.

DESCRIPTION OF THE PREFERRED EMBODIMENT

Figure 1:
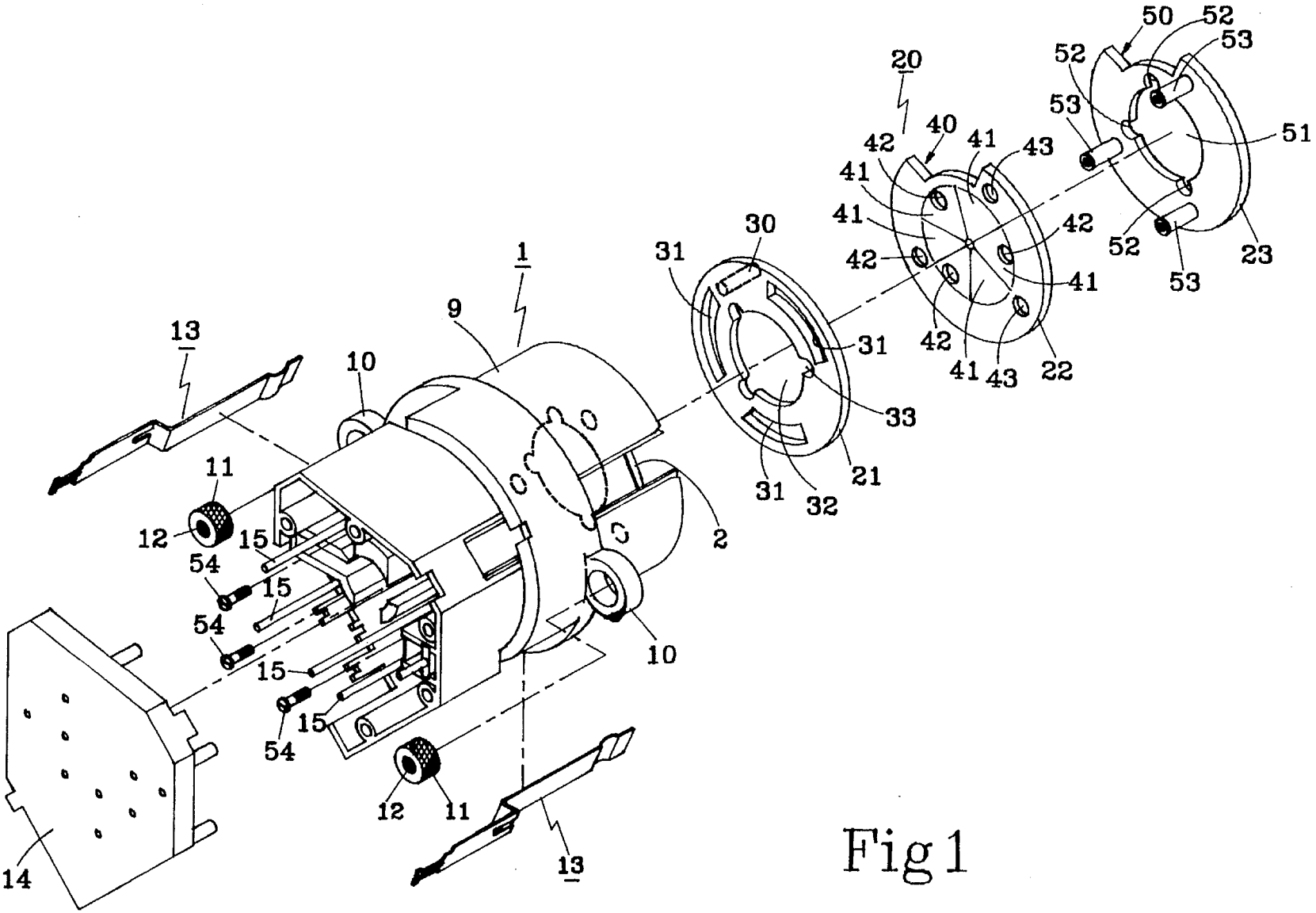
FIG. 1 an exploded perspective view of a multi-function microphone connecter in the present invention.
Figure 3:
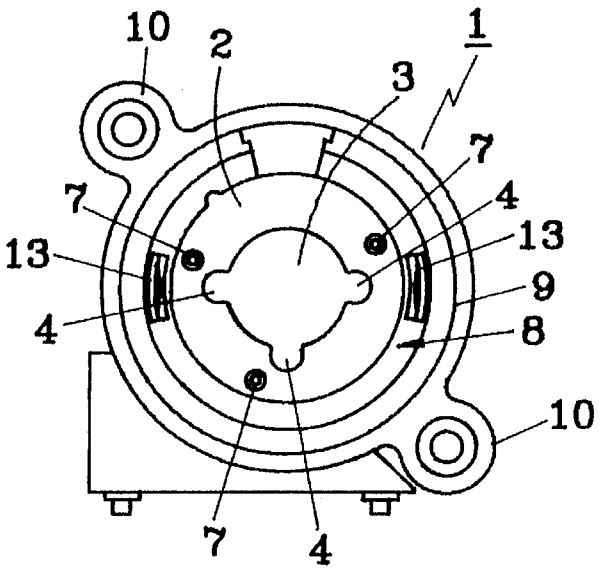
FIG. 3 is a front view of a dust cap unit of the multi-function microphone connecter in the present invention.
Figure 2:
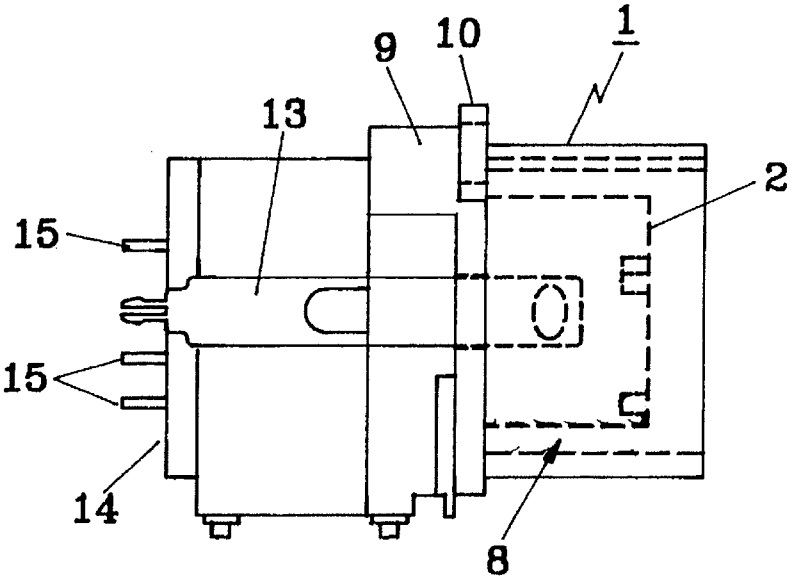
FIG. 2 is a side view of the multi-function microphone connecter without a dust cap unit in the present invention.
Figure 4:
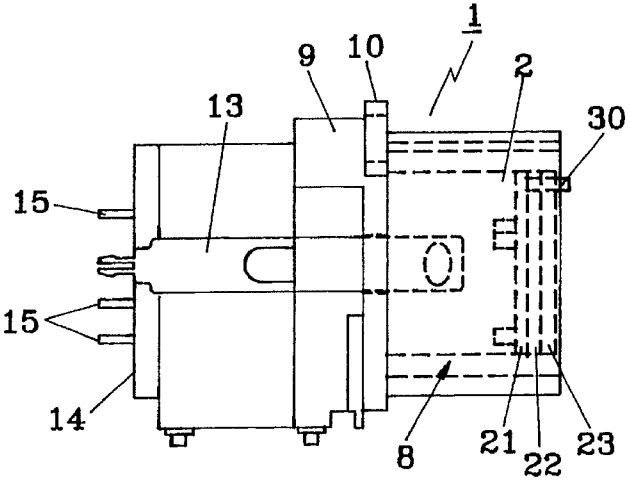
FIG. 4 is a side view of the multi-function microphone connecter in the present invention.
Figure 7:
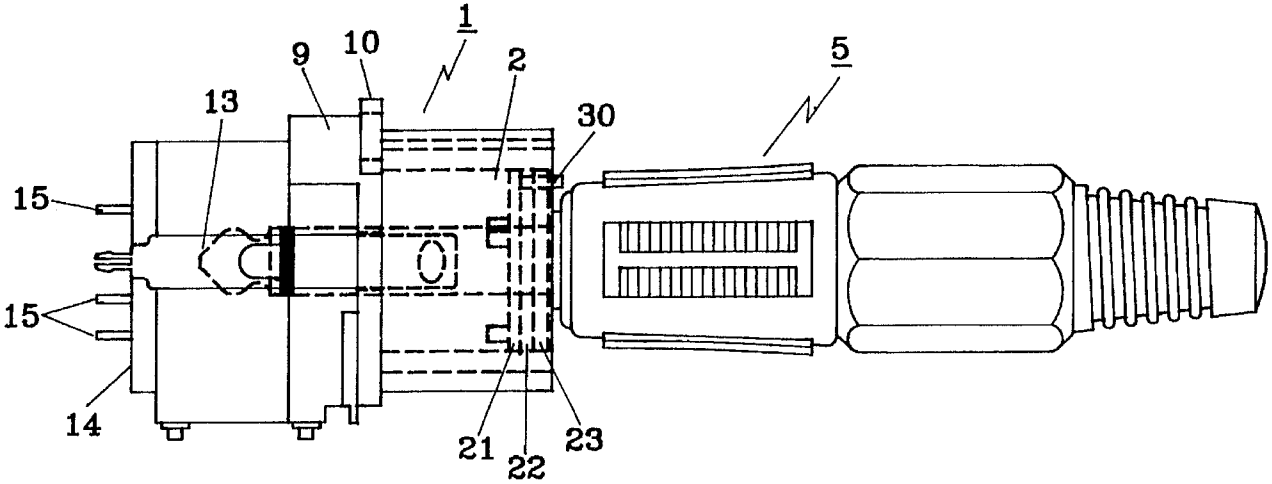
FIG. 7 is a side and part cross-sectional view of the first microphone plug combined with the multi-function microphone connecter in the present invention.
Figure 8:
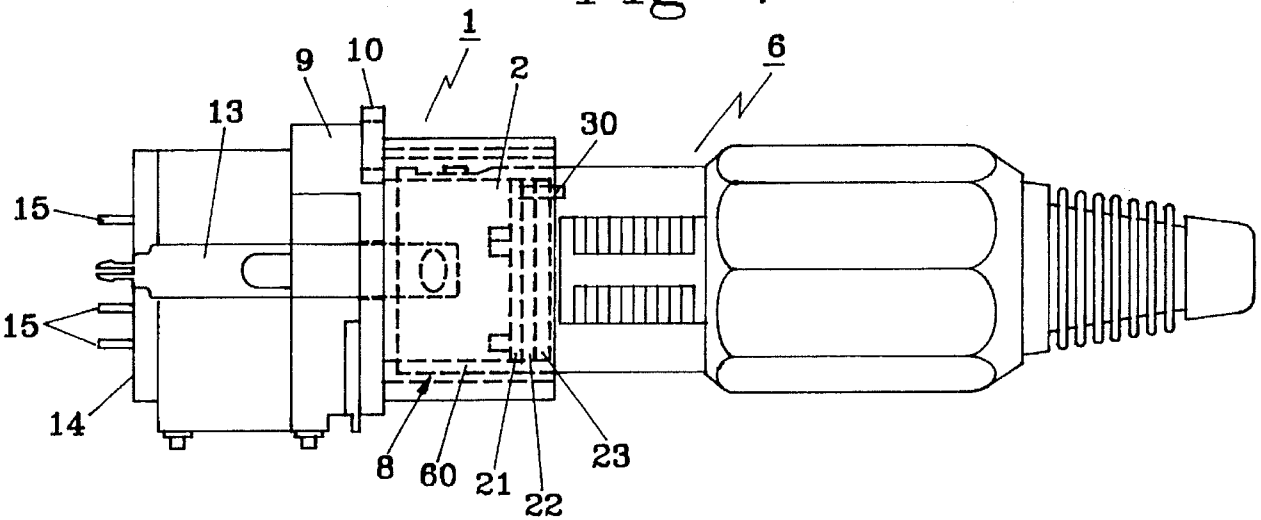
FIG. 8 is a side and part cross-sectional view of the second microphone plus combined with the multi-function microphone connecter in the present invention.
Figure 10:
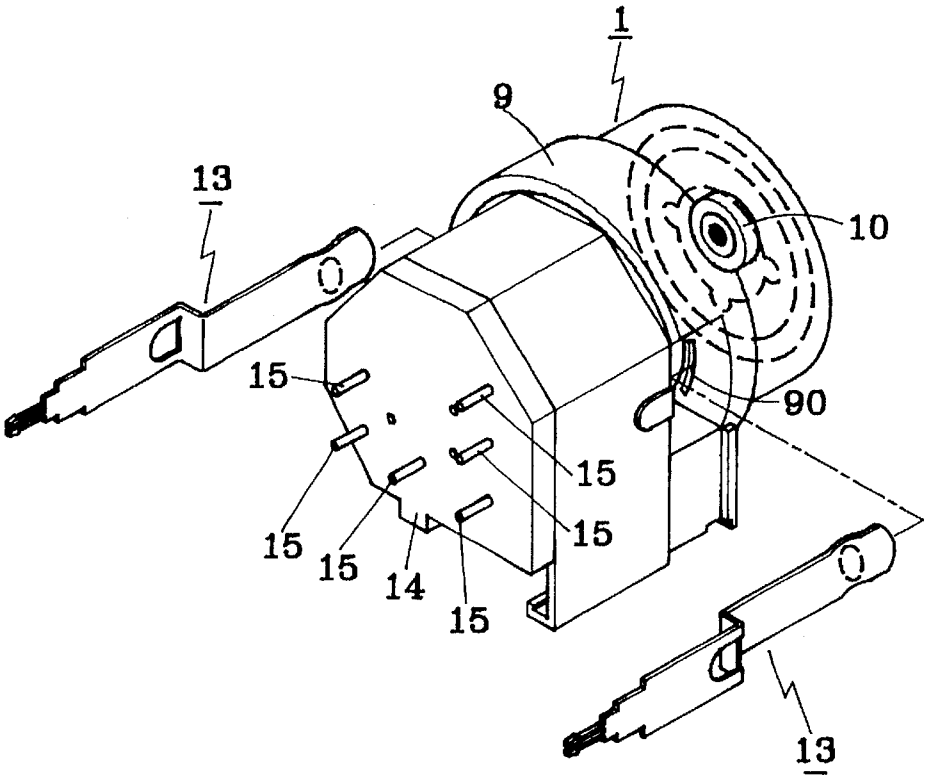
FIG. 10 is a perspective view of the multi-function microphone connecter in the present invention.
Figure 9:
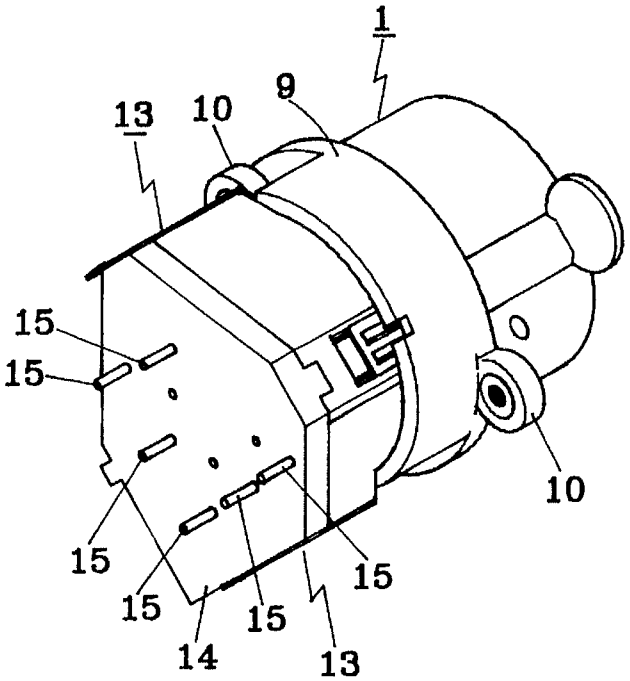
FIG. 9 is a perspective view of a multi-function microphone connecter equipped with a pusher in the present invention.

A preferred embodiment of a multi-function microphone connecter in the present invention, as shown in FIGS. 1, 2 and 3, includes a main body 1 having a cylindrical member 2 provided with a large center plug hole 3 and a plurality of small plug holes 4 spaced apart around the circumferential edge of the large center plug hole 3. The large center plug hole 3 is for a first microphone plug 5 to insert therein as shown in FIG. 7, and the small plug holes 4 are for a second microphone plug 6 to insert therein as shown in FIG. 8, forming the multi-function microphone connecter of this invention.

The cylindrical member 2 has a plurality of lengthwise through holes 7 in an inner annular wall defining the large center plug hole 3, and an annular lengthwise groove 8 defined by the the annular inner wall and art outer annular wall 9 for an annular wall 60 of the second microphone plug 6 to fit therein and to function as a grounding pole. The outer annular wall 9. Further, the main body 1 has two opposite holed ears 10. 10 on the outer surface for a nut 11 to fit forcefully therein, and the nut 11 has a female threaded hole 12.

Further, two grounding plate 13, 13 are provided to be deposited in the main body 1 by inserting it through a lower side hole 90 in the outer annular wall 9 and extending in the annular groove 8 as a grounding pole.

A cap plate 14 is provided to close a rear end wall of the main body 1, detachably attached with the rear end wall after various pins 15 are inserted in respective holes, and securing the pins 15 in their positions.

Figure 6:
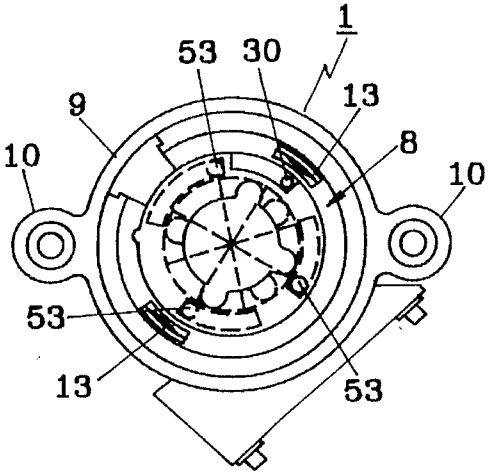
FIG. 6 is a front view of a second microphone plug in the present invention.
Figure 5:
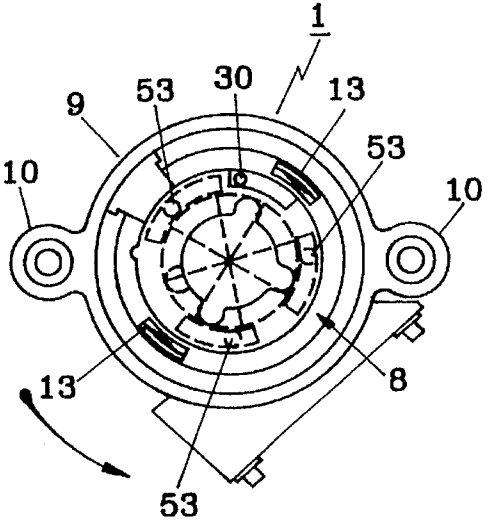
FIG. 5 is a front view of a first microphone plug in the the present invention.

Further, a dust cover unit 20 is provided to close the front end wall of the cylindrical member 2, consisting of a rotatable member 21, a silicon rubber member 22, and an outer cover member 23. The rotatable member 21 has an actuating rod 30 extending laterally from a front side near the outer edge, three curved slots 31 equidistantly spaced apart along near the outer circumferential edge, a large center hole 32 of the same size as the large center plug hole 3 of the main body 1, and a plurality of small holes 33 in corresponding to the small plug holes 4 of the main body 1. The silicon rubber member 22 has a large curved notch 40 in an upper edge for the actuating rod 30 of the rotatable member 21 to fit through and move in the length thereof, a plurality of fan-shaped sections 41 bendable inward in case the first plug 5 is inserted in the large center hole 3 of the main body 1 and able to bend back to the original position after the first plug 5 is pulled out. Therefore, the fan-shaped sections 41 function to prevent dust from moving inward. Besides, the fan-shaped sections 41 respectively have a hole 42 in corresponding to the small plug holes 4 of the main body 1 for the pins of the second plug 6 to extend through. Further, the silicon rubber member 22 has a plurality of combine holes 43 for lateral posts 53 of the outer cover 23 to fit through. The outer cover 23 has a large notch 50 in an upper edge corresponding to the large notch 40 of the silicon rubber member 22 for the lateral post 30 to fit through and move in the length thereof, a large center hole 51 corresponding to the large center hole 32, a plurality of small plug holes 52 corresponding to the small plug holes 4, and a plurality of lateral posts 53 extending through the combine holes 43 of the silicon rubber member 22 and the curved slots 31 of the rotatable member 21 and screwed firmly with bolts 54 passing through the rear end wall of the main body 1, and thus combining firmly the main body 1 with the silicon rubber member 22 and the outer cover 23 and permitting the rotatable member 21 rotate in an angle limited by the notches 40 and 50, as shown in FIGS. 5 and 6. Therefore, the large plug hole 3 and the small plug holes 4 are all covered to prevent dust from moving inward, whether the plug 5 or 6 is inserted therein or not.

While the preferred embodiment of the invention has been described above, it will be recognized and understood that various modification may be made therein and the appended claims are intended to cover all such modifications which may fall within the spirit and scope of the invention.

What is claimed is:

1. A multi-function microphone connecter comprising a main body having a cylindrical member, said cylindrical member having a large center plug hole, a plurality of small plug holes equidistantly spaced apart around an outer circumferential edge of said large center plug hole, an annular inner wall defining said large center plug hole, an annular groove defined by said inner annular wall and an outer annular wall, two opposite combine holed ears extending out of said outer annular wall, a nut provided in a hole of each said opposite combine holed ear, and two grounding plates fixed oppositely on the outer surface of said main body; and characterized by a dust cover unit which consists of a rotatable member, a silicon rubber member and an outer cover member, said rotatable member having a lateral actuating rod, a large center hole, a plurality of small plug holes and a plurality of curved slots, said silicon rubber member having a large notch, a plurality of fan-shaped sections respectively having a small plug hole, a plurality of combine holes spaced apart along near an outer circumferential edge, said outer cover member having a large notch and a large center plug hole and a plurality of lateral posts, said lateral posts extending through said combine holes of said silicon rubber member and said curved slots of said rotatable member and screwed firmly with bolts from inside of said main body, said actuating rod of said rotatable member extending through said large notch of said silicon rubber member and said large notch of said outer cover member so that said rotatable member may be rotated manually to close up said small plug holes of the cylindrical member, preventing dust from drifting and stick therein.

2. The multi-function microphone connecter as claimed in claim 1, wherein said grounding plates are inserted through two opposite holes in an lower side of the outer annular wall to extend in said annular groove of said main body, functioning as a grounding negative pole.

* * * * *